US010124237B2

(12) United States Patent
Contant et al.

(10) Patent No.: US 10,124,237 B2
(45) **Date of Patent: *Nov. 13, 2018**

(54) LEG PAD FOR A HOCKEY PLAYER

(71) Applicant: BAUER HOCKEY, INC., Exeter, NH (US)

(72) Inventors: Mathieu Contant, Verdun (CA); Jean-Francois Laperriere, Prevost (CA); Marco Beauregard, Morin-Heights (CA); Marie-Claude Genereux, Sainte-Therese (CA)

(73) Assignee: BAUER HOCKEY, LLC, Exeter, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/837,598

(22) Filed: Aug. 27, 2015

(65) Prior Publication Data

US 2015/0360116 A1 Dec. 17, 2015

Related U.S. Application Data

(63) Continuation of application No. 13/953,251, filed on Jul. 29, 2013, now Pat. No. 9,132,335, which is a (Continued)

(51) Int. Cl.

| | |
|---|---|
| ***A63B 71/12*** | (2006.01) |
| *A63B 102/24* | (2015.01) |
| *A63B 102/22* | (2015.01) |

(52) U.S. Cl.

CPC .... *A63B 71/1225* (2013.01); *A63B 2071/125* (2013.01); *A63B 2071/1258* (2013.01); (Continued)

(58) Field of Classification Search

CPC .. A41D 13/0543; A41D 13/055; A41D 13/06; A41D 13/065; A41D 13/08; (Continued)

(56) References Cited

U.S. PATENT DOCUMENTS 1,624,129 A 4/1927 Barrett
1,777,088 A * 9/1930 Horath ..... A41D 13/0568 2/22

(Continued)

OTHER PUBLICATIONS

Non Final Office Action dated Jan. 16, 2015 in connection with related U.S. Appl. No. 13/953,251.

(Continued)

*Primary Examiner* — Amy Vanatta

(57) ABSTRACT

The invention relates to a leg pad for a hockey player. The leg pad extends along a longitudinal axis and comprises an upper portion, a lower portion and a band. The upper portion has a knee cap for covering a knee joint of the player. The lower portion has an upper shell for covering a substantial part of a shin of the hockey player and a lower shell for at least partially covering the shin and ankle of the hockey player. The band extends along part of a periphery of the upper shell and part of a periphery of the lower shell. The band interconnects the upper shell and the lower shell to one another wherein the lower shell is movable relative to the upper shell between a first position and a second position in response to flexion of the ankle.

35 Claims, 6 Drawing Sheets

Related U.S. Application Data continuation of application No. 13/475,395, filed on May 18, 2012, now Pat. No. 8,510,862.

(52) U.S. Cl.
CPC ... *A63B 2071/1275* (2013.01); *A63B 2102/22* (2015.10); *A63B 2102/24* (2015.10)

(58) Field of Classification Search
CPC .... A63B 2071/1258; A63B 2071/1275; A63B 2071/125; A63B 71/1225; A63B 2071/1283; A63B 2102/22; A63B 2102/24; A61F 5/0102
USPC ..... 2/22, 24, 16, 23, 242, 267; 602/16, 23, 602/26
See application file for complete search history.

(56) References Cited

U.S. PATENT DOCUMENTS 2,982,968 A 5/1961 Groot
3,135,964 A * 6/1964 Pender ..... A63B 71/1225 2/22
3,761,960 A 10/1973 Woodcock
3,772,704 A 11/1973 Carbonneau
4,633,529 A * 1/1987 Litz ..... A63B 71/1225 2/22
4,674,157 A 6/1987 Litz
4,692,946 A 9/1987 Jurga
4,698,845 A 10/1987 Cosby
D297,178 S 8/1988 Jurga
4,876,745 A * 10/1989 Richards ..... A41D 13/0568 2/24
4,888,826 A * 12/1989 Parsons, Jr. ..... A63B 71/1225 2/22
5,507,720 A * 4/1996 Lampropoulos ..... A61F 5/0111 2/22
5,662,594 A * 9/1997 Rosenblatt ..... A61F 5/0125 2/16
5,732,411 A 3/1998 Coleman et al.
5,742,938 A 4/1998 Winningham et al.
5,806,092 A 9/1998 Shikatani
5,898,939 A 5/1999 Schramm
6,128,779 A * 10/2000 Goldsmith ..... A41D 13/065 2/22
6,131,195 A 10/2000 Foreman
6,178,555 B1 1/2001 Williams
6,178,556 B1 1/2001 Foreman et al.
6,560,781 B1 5/2003 Keene et al.
6,654,961 B2 12/2003 Beland
6,687,912 B2 2/2004 Collins et al.
D501,690 S * 2/2005 Chen ..... D29/120.1
6,912,729 B2 7/2005 Nishimoto
6,964,062 B1 11/2005 Chen
7,188,370 B2 * 3/2007 Bevier ..... A63B 71/1225 2/22
7,797,760 B2 9/2010 Morrow et al.
7,797,764 B2 9/2010 Norris
7,832,017 B2 11/2010 Nascimento et al.
7,845,017 B2 12/2010 Godshaw et al.
2004/0083527 A1 5/2004 Budda
2005/0015841 A1 1/2005 Hoffman
2005/0246812 A1 * 11/2005 Bevier ..... A63B 71/1225 2/22
2006/0107433 A1 * 5/2006 Olson ..... A61F 5/0104 2/22
2007/0250977 A1 * 11/2007 Brown ..... A41D 13/0543 2/22
2008/0120756 A1 5/2008 Shepherd
2009/0025114 A1 1/2009 Hudon et al.
2010/0107291 A1 * 5/2010 Carter ..... F41H 1/02 2/2.5
2010/0229276 A1 9/2010 Bevier

OTHER PUBLICATIONS

Examiner's Report dated Jul. 22, 2015 in connection with corresponding Canadian Patent Application No. 2,777,785.

* cited by examiner

LEG PAD FOR A HOCKEY PLAYER

CROSS-REFERENCE TO RELATED APPLICATION

This application is a continuation application of U.S. application Ser. No. 13/953,251 filed on Jul. 29, 2013, which is a continuation application of U.S. application Ser. No. 13/475,395 filed on May 18, 2012, the contents of which are incorporated herein by reference in their entirety.

FIELD OF THE INVENTION

The present invention relates to a leg pad for a hockey player. The leg pad provides adequate protection and flexion in the ankle region of the player.

BACKGROUND OF THE INVENTION

In recent years, sporting equipment has been evolving to accommodate the need for increased protection. Due to the competitive and aggressive nature of some sports, it has been an objective of sports equipment makers to improve protective gear all the while permitting flexibility and comfort for the player. However, in many cases, an increase in protection can lead to a decrease in maneuverability due to the rigidity of the protective material.

Conventional hockey leg pads generally comprise two protective portions. One portion is located in the knee region and the other portion generally protects the shin region. However, depending on the length of the shin protecting region, the ankle may not be adequately protected. In cases where the shin protecting region substantially overlaps the ankle, the player may exhibit discomfort while moving and skating due to the obstructive nature of the rigid protective material at the bottom part of the leg pad. More specifically, the player may experience a limited range of motion in occurrences that require flexing the player's ankle. On the other hand, should the player need a greater range of motion in the ankle region, the player may use a shorter leg pad, but a part of the ankle or forefoot may then be exposed.

There is therefore a need for a hockey leg pad providing adequate protection in the ankle region and having an upper shell and a lower shell is movable relative to the upper shell. According to one feature, a band interconnects the lower shell to the upper shell such that the lower shell is movable between a first position and a second position in response to flexion of the ankle. The bottom part of the upper shell and the top part of the lower shell may overlap when the lower shell is in the first position.

SUMMARY OF THE INVENTION

According to one aspect of the present invention, there is provided a leg pad for a hockey player. The leg pad extends along a longitudinal axis and comprises an upper portion, a bottom portion and a band. The upper portion has a knee cap for covering a knee joint of the player. The bottom portion has an upper shell for covering a substantial part of a shin of the hockey player and a lower shell for at least partially covering the shin and ankle of the hockey player. The band extends along part of a periphery of the upper shell and part of a periphery of the lower shell.

The band interconnects the upper shell and the lower shell to one another wherein the lower shell is movable relative to the upper shell between a first position and a second position in response to flexion of the ankle.

According to another aspect of the present invention, there is provided a leg pad extending along a longitudinal axis and comprising: an upper portion having a knee cap for covering a knee joint of the player; a lower portion having an upper shell for at least partially covering an upper part of a shin of the hockey player and a lower shell for at least partially covering a lower part of the shin and ankle of the hockey player; and a liner mounted to an inner surface of the upper and lower shells; wherein the lower shell is movable relative to the upper shell between a first position and a second position in a lower region of the shin proximate to the player's ankle in response to flexion of the ankle. The upper shell and lower shell overlap when the lower shell is in at least one of the first and second positions. The overlap of the upper and lower shells when the lower shell is in the second position is greater than the overlap of the upper and lower shells when the lower shell is in the first position. The overlap of the upper and lower shells may be between 2 mm and 12 mm when measured along the longitudinal axis when the lower shell is in the first position. The overlap of the upper and lower shells may be between 5 mm and 20 mm when measured along the longitudinal axis when the lower shell is in the second position.

This and other aspects and features of the present invention will now become apparent to those of ordinary skill in the art upon review of the following description of specific embodiments of the invention and the accompanying drawings.

BRIEF DESCRIPTION OF THE DRAWINGS

A detailed description of embodiments of the present invention is provided hereinbelow with reference to the following drawings, in which.

Figure 1:
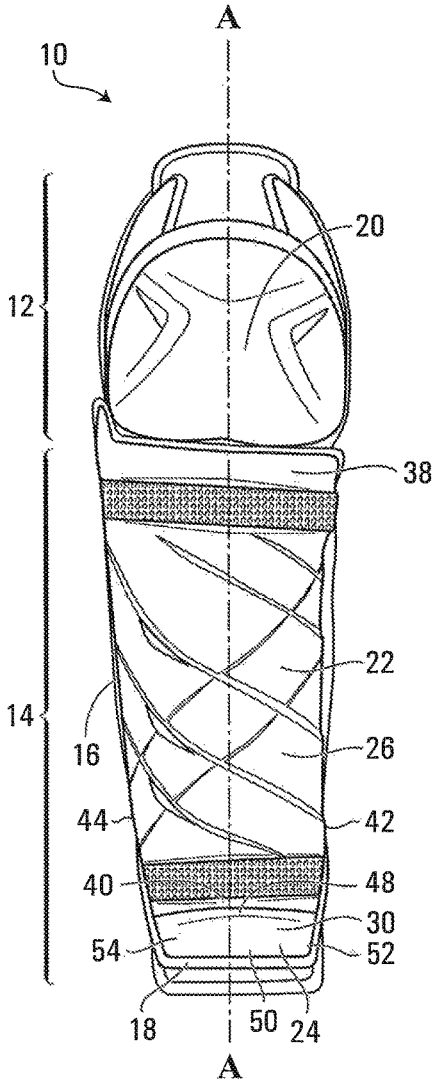
FIG. 1 is a front view of a leg pad in accordance with an embodiment of the invention.

In the drawings, embodiments of the invention are illustrated by way of example. It is to be expressly understood that the description and drawings are only for purposes of illustration and as an aid to understanding, and are not intended to be a definition of the limits of the invention.

DETAILED DESCRIPTION OF THE EMBODIMENTS OF THE INVENTION

To facilitate the description, any reference numeral designating an element in one figure will designate the same element if used in any other figures. In describing the embodiments, specific terminology is resorted to for the sake of clarity but the invention is not intended to be limited to the specific terms so selected, and it is understood that each specific term comprises all equivalents. Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure. Similarly, the terms "inwardly," "outwardly" and "radially" generally refer to the orientation of a surface relative to its axis of elongation, or axis of rotation, as appropriate.

Figure 2:
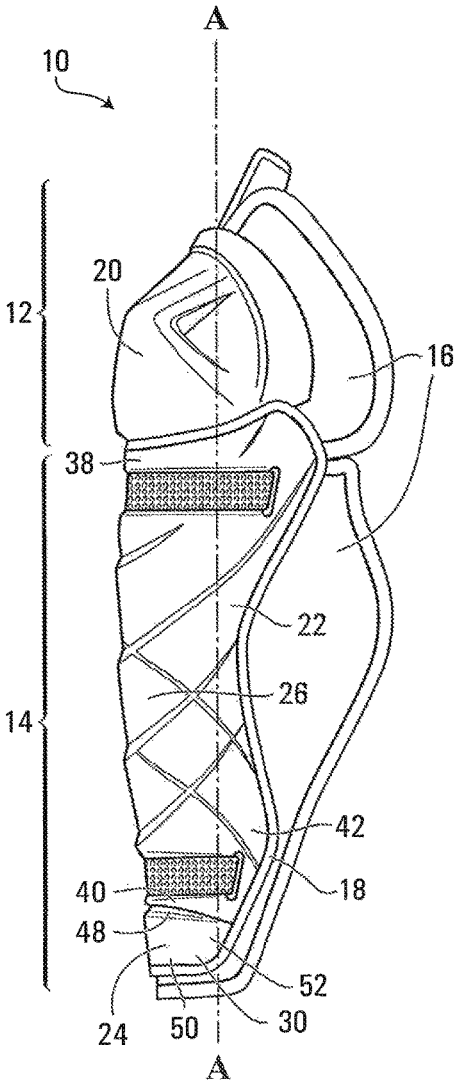
FIG. 2 is a side view of the leg pad of FIG. 1.

With reference to FIGS. 1 and 2, there is shown a non-limiting example of a leg pad 10 in accordance with the invention. The leg pad 10 extends along a longitudinal axis A-A and comprises an upper portion 12, a bottom portion 14, a liner 16 and a band 18. The upper portion 12 comprises a knee cap 20 for protecting the knee of a player's leg. The bottom portion 14 comprises an upper shell 22 and a lower shell 24.

Figure 3A:
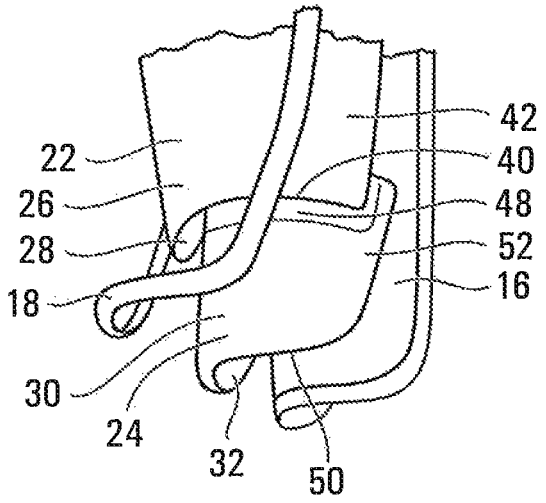
FIG. 3A is an enlarged exploded perspective view of the bottom portion of the leg pad.
Figure 3B:
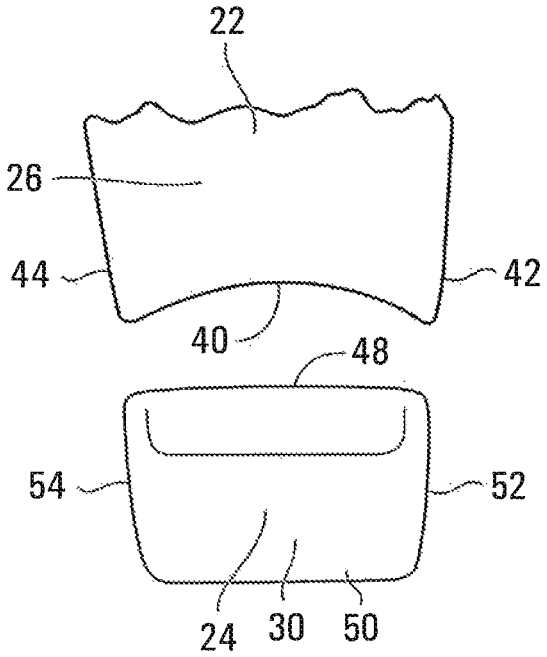
FIG. 3B is an enlarged exploded front view of the bottom portion of the leg pad showing only the upper shell and the lower shell.

With reference to FIGS. 3A and 3B, the upper shell 22 and the lower shell 24 are shown in more detail. The upper shell 22 has an outer side 26 and an inner side 28, the outer side 26 being opposed to the inner side 28. The lower shell 24 has an outer side 30 and an inner side 32, the outer side 30 being opposed to the inner side 32.

The upper shell 22 also comprises a top edge 38, a bottom edge 40, a left edge 42 and a right edge 44 and the lower shell 24 also comprises a top edge 48, a bottom edge 50, a left edge 52 and a right edge 54. The upper shell 22 substantially protects the shin portion of a player's leg and the lower shell 24 substantially protects the ankle portion of a player's leg. More specifically, the lower shell 24 covers the lower front part of the player's ankle and may also cover the player's forefoot.

The upper and lower shells 22, 24 may be made of a rigid plastic material for providing adequate protection in case of impact with a stick, a puck, or collisions with another player for example. It is known in the art that hockey leg shells can be made of nylon, polycarbonate materials, thermoplastics, thermosetting resins, polyethylene, high density polyethylene (HDPE), polypropylene or any other suitable material. In one embodiment, the upper shell 22 and the lower shell 24 may be formed of the same material. In another embodiment, the upper shell 22 and the lower shell 24 may be formed of different materials. In yet another embodiment the upper shell 22 and the lower shell 24 may each comprise a combination of at least two materials. The upper and lower shells 22, 24 may be manufactured or shaped via any method that is known in the art. For example, the upper and lower shells 22, 24 may be molded or thermoformed.

The liner 16 is mounted under the upper and lower shells 22, 24 and is adapted to be disposed between the upper and lower shells 22, 24 and the player's shin and ankle. The liner 16 may be made of any suitable material or composition or materials that provide the degree of cushioning and protection that is desired. The liner 16 may be made of a soft material such as foam, polyethylene, low density polyethylene (LDPE) or any other suitable material. The liner 16 may also be made of foam material covered by layers of woven synthetic yarn, such as closed cell foam of ethylene vinyl acetate covered by a mesh outer layer of a woven synthetic material such as polyester. Such materials would conform itself to the anatomy of the player and may dampen any blows that might occur on the upper shell 22 or lower shell 24. The liner 16 may also be slightly oversized with respect to the upper and lower shells 22, 24 such that the liner 16 may further envelop and protect areas of the player that are not substantially covered by the upper and lower shells 22, 24. It is understood that the liner 16 may be omitted if the upper and lower shells 22, 24 are made, for example, of a rigid outer layer and a soft inner layer affixed to the rigid outer layer.

The band 18 extends along part of a periphery of the upper shell 22 and part of a periphery of the lower shell 24, the band 18 interconnecting the upper shell 22 and the lower shell 24 to one another. In one embodiment, the band 18 extends along the entire periphery of the assembled upper shell 22 and lower shell 24. In another embodiment, the band 18 may extend along a portion of the peripheries of the upper shell 22 and lower shell 24. The band 18 may be a strip of fabric such as a woven stretchable fabric. The band 18 may also be a braiding. The band 18 is an example of a link interconnecting the lower shell 24 and the upper shell 22.

Figure 4A:
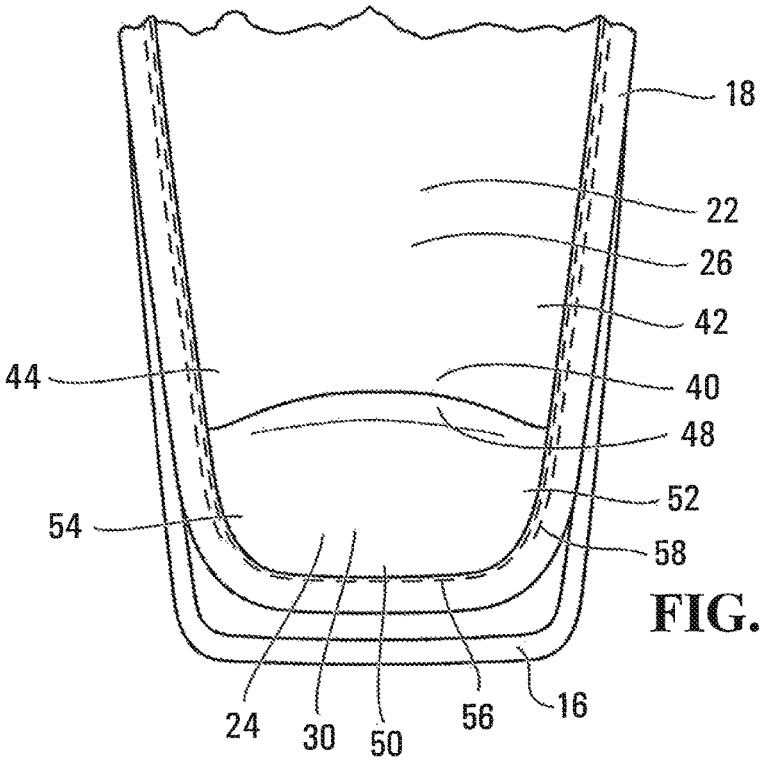
FIG. 4A is an enlarged front view of the bottom portion of the leg pad showing the upper shell, the lower shell, the liner, the band and the stitching lines.
Figure 4B:
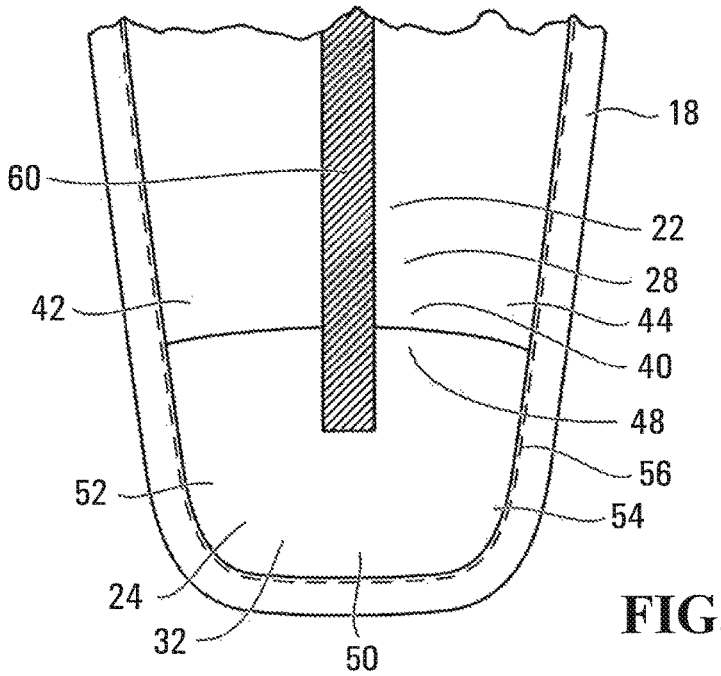
FIG. 4B is an enlarged rear view of the bottom portion of the leg pad showing the upper shell, the lower shell, the strap, the band and the stitching line.
Figure 5A:
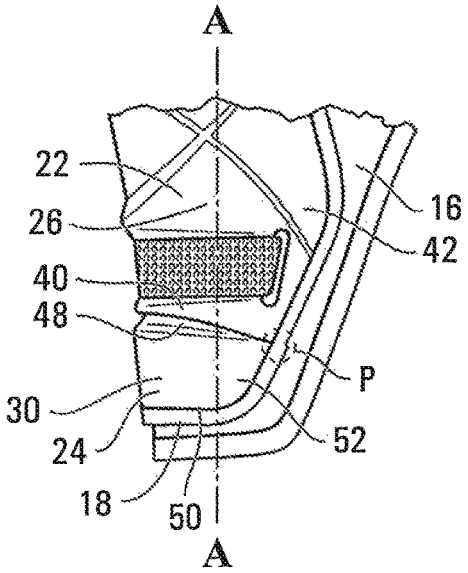
FIG. 5A is an enlarged side view of the bottom portion of the leg pad showing the lower shell in the first position.
Figure 5B:
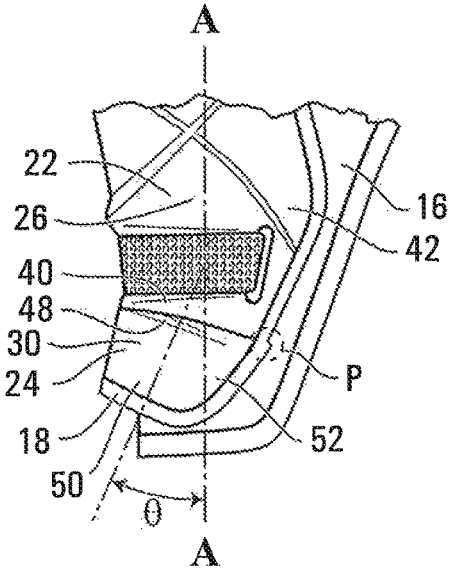
FIG. 5B is an enlarged side view of the bottom portion of the leg pad showing the lower shell in the second position.

The band 18 may have a width large enough to cover at least partially the outer and inner sides and edges of the upper and lower shells 22, 24. As shown in FIGS. 4A and 4B, the band 18 is wide enough to cover a portion of the outer and inner sides 26, 28 and the left and right edges 42, 44 of the upper shell 22 and a portion of the outer and inner sides 30, 32 and the left, right and bottom edges 52, 54, 50 of the lower shell 24. Moreover, as best shown in FIGS. 4A, 5A and 5B, the bottom edge 40 of the upper shell 22 and the top edge 48 of the lower shell 24 are free of the band 18 such that these edges may move relative to one another.

The leg pad 10 may comprise a stitching line 56 passing through the band 18 and the upper shell 22 and passing through the band 18 and the lower shell 24 in order to affix the band 18 to the upper and lower shells 22, 24 such that the band 18 interconnects the upper shell 22 and the lower shell 24 to one another.

It is however understood that the affixation of the band 18 to the upper shell 22 and the lower shell 24 is not limited to such stitching. For example, in another embodiment, the band 18 may be affixed to the upper shell 22 and the lower shell 24 via an adhesive or any other affixing means known in the art.

Furthermore, the band 18 may be attached to the peripheries of the upper shell 22 and the lower shell 24 such that the band 18 biases the lower shell 24 towards the first position. Such a bias would avoid that the lower shell 24 undesirably remain in the second position even after the player has extended his/her foot.

The leg pad 10 may also comprise a stitching line 58 passing through the band 18 and the upper shell 22 and liner 16 and passing through the band 18 and the lower shell 24 and liner 16 in order to affix the assembled upper shell 22 and lower shell 24 to the liner 16 such that the band 18 also interconnects the upper and lower shells 22, 24 to the liner 16.

Figure 6A:
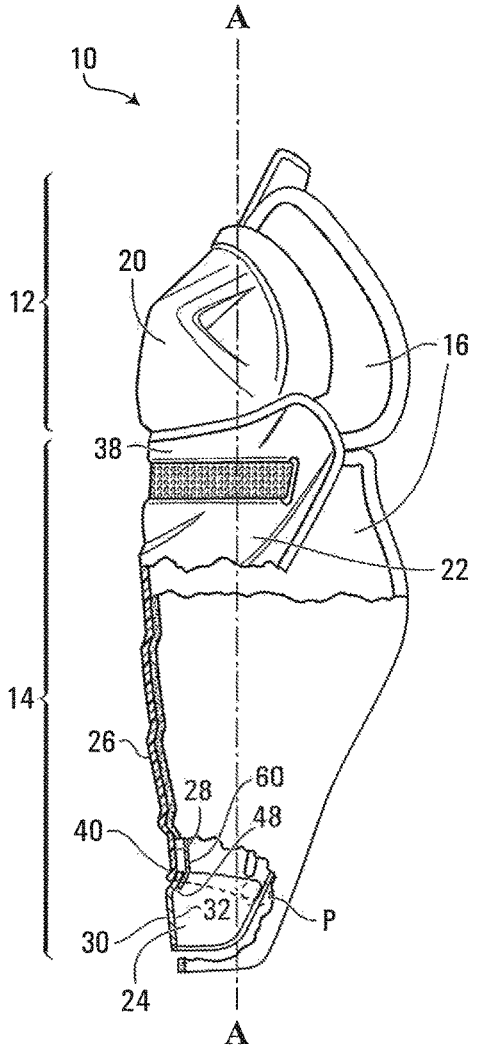
FIG. 6A is a side view of the leg pad showing a partial cross section of the lower portion of the leg pad and the lower shell in the first position.
Figure 6B:
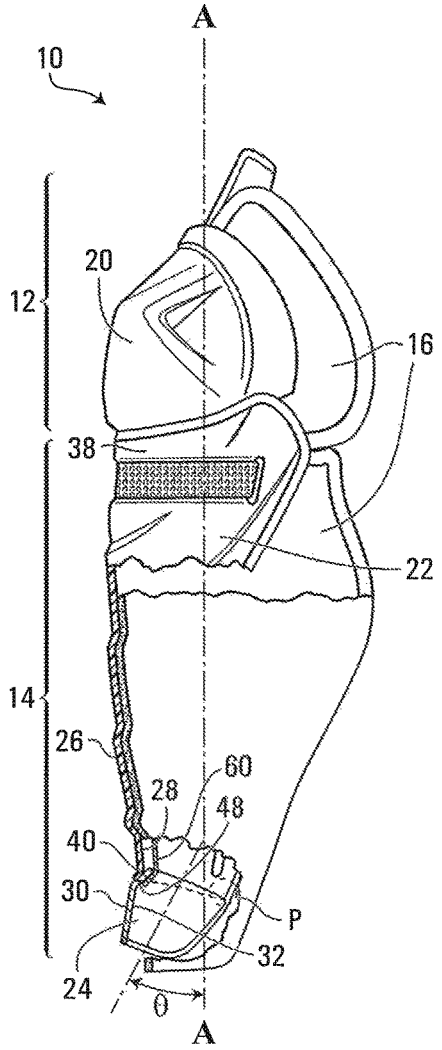
FIG. 6B is a side view of the leg pad showing a partial cross section of the lower portion of the leg pad and the lower shell in the second position.

In either case, the lower shell 24 is movable relative to the upper shell 22 in response to a flexion motion of the player's ankle. As best shown in FIGS. 5A, 5B, 6A and 6B, the movement induced by the flexion movement of the player's ankle will cause the lower shell 24 to move from a first position to a second position. As best shown in FIGS. 5A and 6A, when the lower shell 24 is in the first position, the lower shell 24 may be in an extended position where it extends generally parallel to the longitudinal axis A-A of the leg pad such that the upper and lower shells 22, 24 are generally straight or rectilinear. As best shown in FIGS. 5B and 6B, when the lower shell 24 moves from the first position to the second position in response to the flexion motion of the player's angle, the lower shell 24 then pivots about a pivot region P and defines an angle θ relative to the longitudinal axis A-A of the leg pad. Hence, in the second position, the lower shell 24 may be in a retracted or angled position where it extends along an axis that defines an angle θ relative to the longitudinal axis A-A. In one embodiment, the angle θ relative to the longitudinal axis may be up to 10°. In another embodiment, the angle θ relative to the longitudinal axis may be up to 15°. It is understood that the movement of the lower shell 24 relative to the upper shell 22 may be a combination of a pivotable movement and a slight translation movement that is allowed, for example, by the stretchability of the band 18 (see the band 18 in the pivot region P).

As shown in FIG. 6A, when the lower shell 24 is in the first position, the upper and lower shells 22, 24 are positioned relative to one another to avoid a gap therebetween. More particularly, in the first position, there is a first overlap between the bottom edge 40 of the upper shell 22 and the top edge 48 of the lower shell 24.

In the first position, the first overlap, when measured along the longitudinal axis A-A, may be between 2 mm and 12 mm. In another embodiment, this first overlap may be between 5 mm and 10 mm. When the lower shell 24 is in the second position, as shown in FIG. 6B, there is a second overlap between the bottom edge 40 of the upper shell 22 and the top edge 48 of the lower shell 24, the second overlap being greater than the first overlap. In the second position, the second overlap, when measured along the longitudinal axis A-A, may be between 5 mm and 20 mm. In another embodiment, this second overlap may be between 15 mm and 20 mm. As best shown in FIGS. 5A, 5B, 6A and 6B, the bottom edge 40 of the upper shell 22 overlaps the top edge 48 of the lower shell 24 in order to avoid a gap when the lower shell 24 moves from the second position to the first position.

Figure 7:
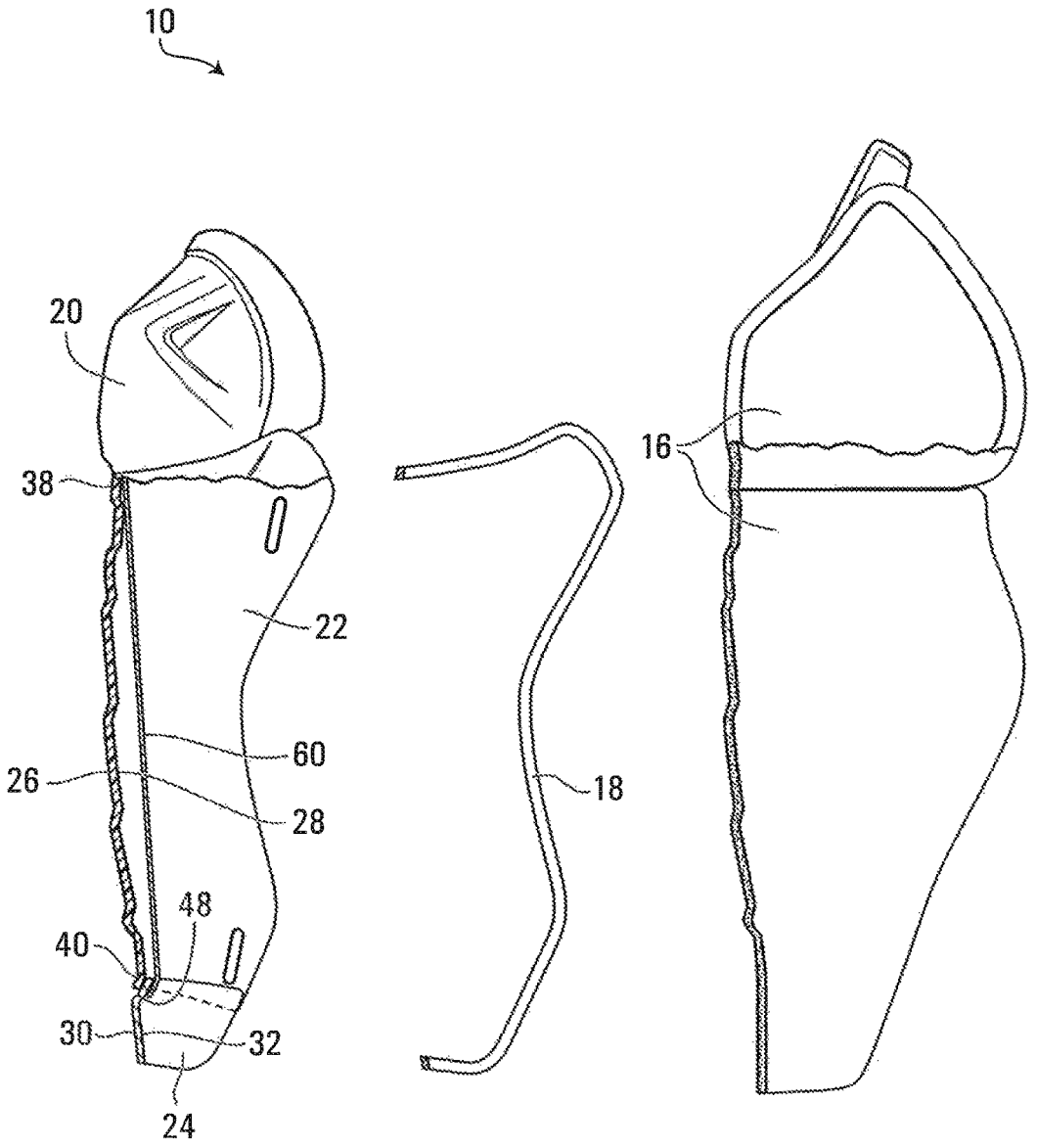
FIG. 7 is a side exploded view of the leg pad showing a cross section of the lower portion of the leg pad.

As best shown in FIGS. 4B and 7, the leg pad 10 may comprise a strap 60 which connects the upper shell 22 and the lower shell 24. The strap 60 may be connected to the inner sides 28, 32 of the upper and lower shells 22, 24. The strap 60 may restrict the top edge 48 of the lower shell 24 from moving over the bottom edge 40 of the upper shell 22. The strap 60 may also ensure that the lower shell 24 remains generally parallel to the longitudinal axis A-A of the leg pad 10 when pressure is applied on the lower shell for moving/pivoting the lower shell 24 inwardly (for example, in a direction towards a player's ankle).

Although various embodiments have been illustrated, this was for the purpose of describing, but not limiting, the invention. Various changes, modifications and enhancement may be made to the embodiments and the scope of the claims should not be limited by the embodiments, but should be given the broadest interpretation consistent with the description as a whole.

The invention claimed is:

1. A hockey leg pad for a hockey player, the hockey leg pad comprising:

(a) an upper portion including a knee cap configured to overlie and protect a knee joint of the hockey player; and (b) a lower portion including a rigid upper shell configured to overlie and protect an upper part of a shin of the hockey player and a rigid lower shell configured to overlie and protect a lower part of the shin of the hockey player proximate to an ankle of the hockey player, the lower shell being smaller than the upper shell;

wherein the upper shell and the lower shell are connected to one another such that the lower shell is movable relative to the upper shell between an extended position and a flexed position in response to flexion of the ankle of the hockey player while skating; wherein the upper shell and the lower shell overlap both in the extended position and in the flexed position; wherein a bottom edge of the lower shell is configured to overlie the lower part of the shin of the hockey player or the ankle of the hockey player in both the extended position and the flexed position; and wherein the overlap of the upper and lower shells when the lower shell is in the flexed position is greater than the overlap of the upper and lower shells when the lower shell is in the extended position.

2. A hockey leg pad as defined in claim 1, the hockey leg pad extending along a longitudinal axis, wherein, when the lower shell is in the extended position, the overlap of the upper and lower shells is between 2 mm and 12 mm when measured along the longitudinal axis.

3. A hockey leg pad as defined in claim 1, the hockey leg pad extending along a longitudinal axis, wherein, when the lower shell is in the flexed position, the overlap of the upper and lower shells is between 5 mm and 20 mm when measured along the longitudinal axis.

4. A hockey leg pad as defined in claim 1, wherein the lower shell defines an angle relative to a longitudinal axis of the hockey leg pad when the lower shell is in the flexed position.

5. A hockey leg pad as defined in claim 4, wherein the angle relative to the longitudinal axis is up to 15°.

6. A hockey leg pad as defined in claim 1, the hockey leg pad extending along a longitudinal axis and comprising a band extending along part of a periphery of the upper shell and part of a periphery of the lower shell, the band interconnecting the upper shell and the lower shell to one another.

7. A hockey leg pad as defined in claim 6, wherein the upper shell has an outer side opposed to an inner side and a peripheral edge between the outer and inner sides, the lower shell has an outer side opposed to an inner side and a peripheral edge between the outer and inner sides, and wherein the band overlies the inner side, outer side and peripheral edge of the upper shell and overlies the inner side, outer side and peripheral edge of the lower shell.

8. A hockey leg pad as defined in claim 7, wherein the peripheral edge of the upper shell has a bottom edge and left and right side edges and the peripheral edge of the lower shell has top and bottom edges and left and right side edges, wherein the band covers the left and right side edges of the upper and lower shells and wherein the bottom edge of the upper shell and the top edge of the lower shell are free of the band.

9. A hockey leg pad as defined in claim 8, wherein the band further covers the bottom edge of the lower shell.

10. A hockey leg pad as defined in claim 6, wherein the band is a strip of woven stretchable fabric.

11. A hockey leg pad as defined in claim 6, wherein the band is a braiding.

12. A hockey leg pad as defined in claim 8, wherein the band is a braiding that has a width large enough for covering the left and right side edges of the upper and lower shells and the bottom edge of the lower shell.

13. A hockey leg pad as defined in claim 12, wherein a stitch line affixes the braiding to at least one of the inner and outer sides of either of the upper and lower shells.

14. A hockey leg pad as defined in claim 6, wherein the band biases the lower shell towards the extended position.

15. A hockey leg pad as defined in claim 7, wherein the leg pad also comprises a strap connecting the inner side of the upper shell to the inner side of the lower shell.

16. A hockey leg pad as defined in claim 15, wherein the upper shell has a bottom edge and the lower shell has a top edge and wherein the strap restricts the top edge of the lower shell from moving over the bottom edge of the upper shell.

17. A hockey leg pad as defined in claim 16, wherein, in use, the strap ensures that the lower shell remains generally parallel to the longitudinal axis of the leg pad when pressure is applied to the lower shell for moving the lower shell inwardly.

18. A hockey leg pad as defined in claim 1, the hockey leg pad extending along a longitudinal axis, wherein the lower shell is generally parallel to the longitudinal axis when in the extended position.

19. A hockey leg pad as defined in claim 1, wherein the lower portion is configured so as to bias the lower shell towards the extended position.

20. A hockey leg pad as defined in claim 1, comprising a liner disposed behind the upper and lower shells, wherein the lower shell is movable relative to the liner.

21. A leg pad as defined in claim 20, wherein the liner is made of foam, polyethylene, low density polyethylene or foam covered by layers of woven synthetic yarn.

22. A hockey leg pad as defined in claim 1, comprising a link affixed to the upper shell and the lower shell and configured such that the lower shell is movable relative to the upper shell between the extended position and the flexed position.

23. A hockey leg pad as defined in claim 22, wherein a material of the link is different from a material of the upper shell and a material of the lower shell.

24. A hockey leg pad as defined in claim 23, wherein the material of the link is fabric.

25. A hockey leg pad as defined in claim 22, wherein the link comprises a band extending along part of a periphery of the upper shell and part of a periphery of the lower shell.

26. A hockey leg pad for a hockey player, the hockey leg pad comprising:

(a) an upper portion including a knee cap configured to overlie and protect a knee joint of the hockey player; and (b) a lower portion including a rigid upper shell configured to overlie and protect an upper part of a shin of the hockey player and a rigid lower shell configured to overlie and protect a lower part of the shin of the hockey player proximate to an ankle of the hockey player, the lower shell being smaller than the upper shell;

wherein the upper shell and the lower shell are separate from one another and connected to one another such that the lower shell is movable relative to the upper shell between an extended position and a flexed position in response to flexion of the ankle of the hockey player while skating; wherein the lower shell is configured to surround at least part of a lower region of the shin proximate to the ankle; wherein the upper shell and the lower shell are configured to avoid a gap therebetween in both the extended position and the flexed position; wherein, both in the extended position and in the flexed position, the upper shell and the lower shell overlap; and wherein the overlap of the upper shell and the lower shell when the lower shell is in the flexed position is greater than the overlap of the upper shell and the lower shell when the lower shell is in the extended position.

27. A hockey leg pad as defined in claim 26, wherein a bottom of the lower shell is configured to overlie the lower part of the shin of the hockey player or the ankle of the hockey player in both the extended position and the flexed position.

28. A hockey leg pad as defined in claim 26, comprising a liner disposed behind the upper shell and the lower shell.

29. A hockey leg pad as defined in claim 28, wherein the liner comprises foam.

30. A hockey leg pad as defined in claim 28, wherein the liner comprises fabric.

31. A hockey leg pad as defined in claim 26, comprising a link affixed to the upper shell and the lower shell and configured such that the lower shell is movable relative to the upper shell between the extended position and the flexed position.

32. A hockey leg pad as defined in claim 31, wherein a material of the link is different from a material of the upper shell and a material of the lower shell.

33. A hockey leg pad as defined in claim 32, wherein the material of the link is fabric.

34. A hockey leg pad as defined in claim 31, wherein the link comprises a band extending along part of a periphery of the upper shell and part of a periphery of the lower shell.

35. A hockey leg pad as defined in claim 28, wherein the lower shell is movable relative to the liner.

* * * * *